United States Patent [19]

Kincaid

[11] 4,374,299

[45] Feb. 15, 1983

[54] TRIBOELECTRIC TRANSDUCER CABLE

[75] Inventor: John Kincaid, Batavia, Ill.

[73] Assignee: Belden Corporation, Geneva, Ill.

[21] Appl. No.: 150,795

[22] Filed: May 19, 1980

[51] Int. Cl.[3] ..... H01B 11/06

[52] U.S. Cl. ..... 174/36; 174/105 SC; 174/106 SC; 174/115; 340/38 R

[58] Field of Search ..... 174/115, 105 SC, 106 SC, 174/36; 340/596, 38 R, 565, 566, 562

[56] References Cited

U.S. PATENT DOCUMENTS

| | | | |
|---|---|---|---|
| 2,446,387 | 8/1948 | Peterson | 174/105 SC |
| 2,787,784 | 4/1957 | Meryman | 340/596 |
| 2,981,788 | 4/1961 | Bunish | 174/115 |
| 3,032,604 | 5/1962 | Timmons | 174/115 |
| 3,660,592 | 5/1972 | Anderson | 174/115 X |
| 3,668,625 | 6/1972 | Wolf | 340/38 R |
| 3,816,644 | 6/1974 | Giffel | 174/115 |
| 3,911,390 | 10/1975 | Myers | 174/115 X |
| 4,234,759 | 11/1980 | Harlow | 174/115 X |
| 4,323,721 | 4/1982 | Kincaid | 174/36 |

FOREIGN PATENT DOCUMENTS

| | | | |
|---|---|---|---|
| 225043 | 1/1959 | Australia | 174/115 |

*Primary Examiner*—R. R. Kucia

*Attorney, Agent, or Firm*—Fitch, Even, Tabin, Flannery & Welsh

[57] ABSTRACT

Two embodiments of a triboelectric transducer cable for generating a signal in response to movement or deformation of the cable each include multiple insulated central conductors, a semi-conductive wrapping separately surrounding each of the insulated central conductors with an additional conductor arranged in electrically conductive contact with the semi-conductive wrapping and a protective jacket surrounding the cable assembly.

9 Claims, 2 Drawing Figures

TRIBOELECTRIC TRANSDUCER CABLE

BACKGROUND OF THE INVENTION

The present invention relates to a triboelectric transducer cable for generating an electrical signal in response to movement or deformation of the cable and, more specifically, to such a triboelectric transducer cable including a novel combination of components for substantially enhancing the ability of the cable to generate a signal in response to movement or deformation.

The basic triboelectric effect contemplated by the present invention is well known in the prior art. For example, the construction and use of a specially configured cable for generating a signal in response to movement or deformation of the cable is described in U.S. Pat. No. 2,787,784 issued Apr. 2, 1957. As is demonstrated by that patent, for example, the triboelectric effect referred to herein comprises the construction of an electrical cable with "noisy" characteristics. Normally, in the construction of electrical cable, it is desirable to avoid such noisy characteristics because of the interference with a signal being carried along the cable. However, in a triboelectric transducer cable, this same characteristic is desirable for initiating or generating a signal in response to movement or deformation of the cable. Thus, the cable may be used for detection systems where activity adjacent the cable tends to result in movement or deformation of the cable to initiate an electrical signal. Thus, such cable may be used for example in security and surveillance systems.

The triboelectric effect known in the prior art is achieved by constructing a cable having two or more conductor members with a dielectric or insulating material arranged between and generally closely adjacent one or both of the conductor members. The insulating material is commonly a flexible, deformable material formed as a conduit loosely surrounding one or both of the conductor members so that relative movement between the conductor member and dielectric or insulator member tends to initiate an electrical signal because of the triboelectric effect. Such a triboelectric cable may also be formed with a shield member in order to minimize the effect of stray electrical fields surrounding the cable. In addition, the cable may commonly be provided with a protective cover or seal as is conventional for many conducting electrical cables.

In the prior art, however, substantial movement or deformation of the cable has been required in order to generate a suitable signal. At the same time, because of the substantial movement or deformation required, it has generally been necessary to provide insulators which have relatively high resilience so that they may recover and maintain their ability to provide the triboelectric effect.

Accordingly, there has been found to remain a need for a triboelectric transducer cable capable of generating a signal in response to relatively limited movement or deformation of the cable.

SUMMARY OF THE INVENTION

It is therefore an object of the present invention to provide a triboelectric transducer cable including a novel combination of elements in order to initiate or generate an electrical signal in response to minimal movement or deformation of the cable.

More specifically, it is an object of the present invention to provide a triboelectric transducer cable having a semi-conductive element separately wrapped around two insulated conductors. A third conductor element or drain wire is preferably arranged in electrically conductive contact with the semi-conductive element, a protective jacket or seal surrounding the entire triboelectric cable assembly.

However, the present invention is not limited to use of two insulated conductors within the triboelectric transducer cable. For certain applications, the use of at least three insulated conductors may be desirable, for example, to produce a stronger triboelectric signal. Accordingly, it is also an object of the invention to provide a triboelectric transducer cable of the type referred to above including three insulating conductors with a semi-conductive element providing separate wrappings for the three insulated conductors, a drain wire being in electrically conductive contact with the semi-conductive wrapping for each of the insulated conductors.

Additional objects and advantages of the present invention will be apparent from the following description having reference to the accompanying drawings.

DESCRIPTION OF THE PREFERRED EMBODIMENTS

As was discussed above, the triboelectric transducer cable of the present invention comprises a semi-conductive element independently wrapped around two insulated conductors while being in electrically conductive contact with another conductor serving as a drain wire. Such a combination has been found to particularly and unexpectedly enhance the generation of a triboelectric signal. The novel combination of the insulated conductors in combination with the semi-conductive element and an electrical conductor or drain wire in electrically conductive contact with the semi-conductive element is the basic combination of the present invention responsible for this improved triboelectric effect. Within the novel combination of the present invention, the semi-conductive element preferably serves the two functions of stimulating triboelectric charge generation within the cable while also providing a conduction path to the conductor with which it is in electrical contact and which thus serves as a drain wire within the cable. In accordance with the prior art, the drain wire and the insulated conductor or insulated conductors may be conventionally connected with a high input impedance amplifier for receiving and measuring a signal generated along the length of the cable.

The specific function of the semi-conductive element in stimulating or enhancing the triboelectric effect or charge generation within the cable is not completely understood. However, the semi-conductive layer has been found to unexpectedly accomplish this advantageous function. Preferably, the semi-conductive element is formed as a "figure-eight" about the two insulated conductors while being in electrical contact with yet another conductor serving as a drain wire for the cable. In any event, it will be noted from the following description that the semi-conductive element within the combination of the present invention serves a function which is generally contrary to the normal use of semi-conductive elements to suppress charge generation.

Figure 1:
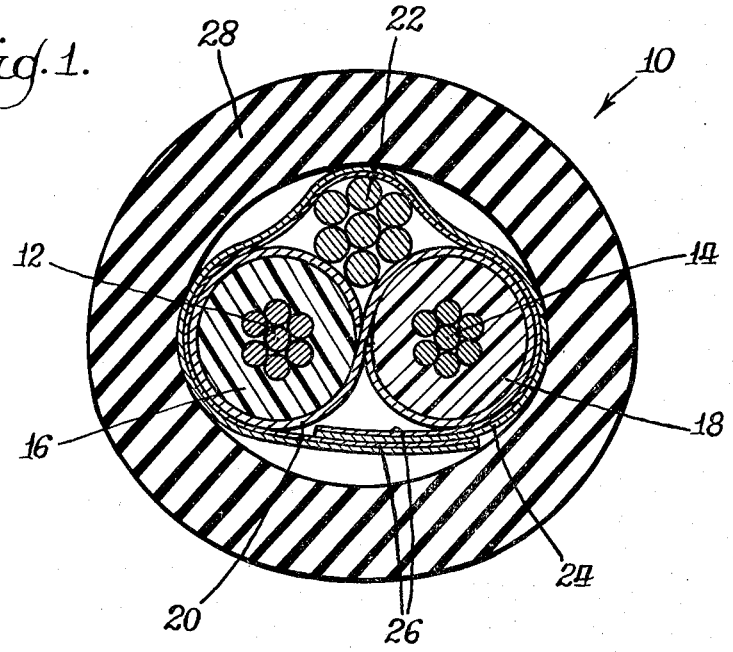
FIG. 1 is a sectioned view of a triboelectric transducer cable constructed according to the present invention.

Referring now to FIG. 1, a triboelectric transducer cable constructed in accordance with the present invention is generally indicated at 10 and includes a pair of insulated central conductors respectively indicated at 12 and 14. Insulation for the central conductors 12 and 14 is indicated respectively at 16 and 18. The central conductors 12 and 14 may be conventional wire conductors surrounded by suitable insulating or dielectric material. It is relatively important that the dielectric plastic or insulating material forming the insulation for the central conductors 12 and 14 remain physically separate from the semi-conductive material. Actual spacing between these materials is not necessary. However, it is believed important to prevent any bonding between the insulation and the semi-conductive materials in order to maintain the triboelectric generating effect. Accordingly, the insulation material is preferably formed from a dielectric plastic or the like having a relatively higher melting point such as a polyolefin plastic or plastic of the type sold under the trademark FEP TEFLON.

A semi-conductive element 20 independently surrounds the two insulated central conductors 12 and 14. Preferably, the semi-conductive element 20 is a carbon-embedded nylon tape which is wrapped in a figure-eight configuration around the two insulated central conductors 12 and 14. Another electrical conductor 22 of uninsulated stranded form serves as a drain wire for the cable. In accordance with the present invention, it is important that the conductor or drain wire 22 be in electrically conductive contact with the semi-conductive element.

The conductor or drain wire 22 may be arranged inside or outside the cylinder formed by the semi-conductive tape 20. However, it is preferably arranged outside of the semi-conductive tape 20 while a conductive shield element 24 is wrapped about both the semi-conductive tape 20 and drain wire 22 while being in electrically conductive contact with both in order to further enhance or stimulate the triboelectric charge generation in combination with the insulated central conductors 12 and 14. The conductive shield element 24 is formed, for example, from polyester tape having a thin conductive aluminum layer 26 arranged in electrically conductive contact with both the drain wire 22 and semi-conductive tape 20.

The entire triboelectric cable assembly 10 is enclosed by a conventional seal or jacket 28 in order to provide insulation and protection for the shield element 24, drain wire 22, semi-conductive tape 20 and the other cable components.

Figure 2:
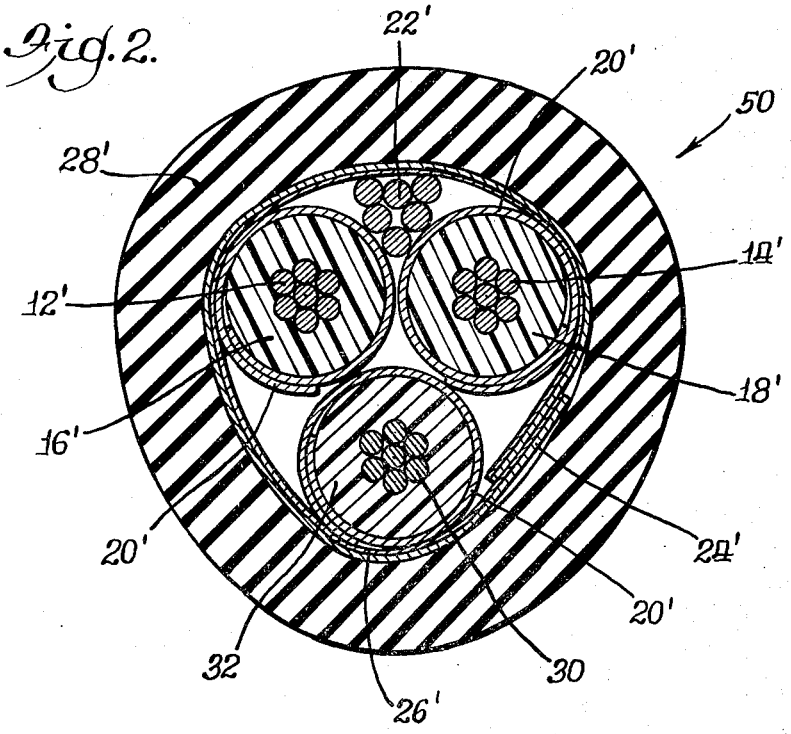
FIG. 2 is a similar view of another embodiment of the invention.

The embodiment of the invention illustrated in FIG. 2 includes a triboelectric cable assembly 50 including similar components as the cable assembly 10 of FIG. 1. Accordingly, similar components within the cable assembly 50 are indicated by corresponding primed numerals. The cable assembly 50 of FIG. 2 operates in substantially the same manner as the cable assembly 10 of FIG. 1. However, within the cable assembly 50, the figure-eight wrap for the semi-conductive tape 20 of FIG. 1 is replaced by similar but separate semi-conductive elements 20' which are respectively wrapped about the two insulated central conductors 12' and 14'. The cable assembly 50 also includes a third insulated central conductor 30 with insulation 32. The third insulated conductor is separately wrapped by one of the semi-conductive elements 20'. Otherwise the cable assembly 50 of FIG. 2 is of similar construction as the cable assembly 10 of FIG. 1.

Thus, there has been described a novel triboelectric transducer cable constructed in accordance with the present invention. It will be apparent that numerous modifications and variations are possible within the scope of the present invention. For example, it is believed that the use of three or more insulated conductors within the triboelectric transducer cable, as is illustrated in FIG. 2, may provide improved performance as compared with only two insulated conductors. It is further possible that an even greater number of insulated conductors may be employed within the cable of the present invention. At the same time, it is also noted that a continuous semi-conductive wrap element may be interwoven, in the manner shown in FIG. 1, for a greater number of insulated conductors within the cable. This may be desirable for example to insure electrical continuity between the semi-conductive wrap for each of the insulated conductors and the drain wire. However, it is also possible according to the present invention to provide independent or separate semi-conductive wrappings, as illustrated in FIG. 2, for the two insulated central conductors in the embodiment of FIG. 1. Accordingly, the scope of the present invention is defined only by the following appended claims.

What is claimed is:

1. A triboelectric transducer cable for generating a signal in response to movement or deformation thereof, comprising a pair of insulated central conductors, a semi-conductive element independently wrapped in physically separate and surrounding relation to each of the insulated central conductors, an additional drain wire conductor arranged in electrically conductive contact with the semi-conductive element, said semi-conductive element being unbonded to the insulated central conductors, a conductive shield means surrounding the drain wire conductor and the semi-conductive lazer element and being in electrical contact therewith, and a protective jacket surrounding the insulated central conductors, semi-conductive element, drain wire conductor and shield means of the cable.

2. The triboelectric transducer cable of claim 1 wherein the shield element is wrapped around the semi-conductive element, the drain wire conductor being arranged between the semi-conductive element and shield element.

3. The triboelectric transducer cable of claim 2 wherein the shield element is formed from a plastic having a conductive metallic surface arranged in electrically conductive contact with the drain wire conductor and the semi-conductive element.

4. The triboelectric transducer cable of claim 3 wherein the insulation for each of the central conductors is a dielectric plastic tube, the semi-conductive element being a carbon-embedded nylon tape.

5. The triboelectric transducer cable of claim 4 wherein the semi-conductive element is wrapped in a figure-eight configuration about the pair of insulated central conductors.

6. The triboelectric transducer cable of claim 1 wherein the semi-conductive element is wrapped in a figure-eight configuration about the pair of insulated central conductors.

7. The triboelectric transducer cable of claim 6 wherein the insulation for each of the central conductors is a dielectric plastic tube, the semi-conductive element being formed as a carbon-embedded nylon tape.

8. The triboelectric transducer cable of claim 1 further comprising an additional insulated central conductor also independently surrounded by the semi-conductive element arranged in electrically conductive relation with the drain wire conductor.

9. The triboelectric transducer cable of claim 8 wherein the semi-conductive element is formed by three separate wrappings for the respective insulated central conductors, the additional drain wire conductor being in electrically conductive contact with the semi-conductive wrappings for the three insulated central conductors.

* * * * *

UNITED STATES PATENT AND TRADEMARK OFFICE

CERTIFICATE OF CORRECTION

PATENT NO. : 4,374,299

DATED : February 15, 1983

INVENTOR(S) : John Kincaid

It is certified that error appears in the above-identified patent and that said Letters Patent is hereby corrected as shown below:

Claim 1.
Column 4, Line 42 - "lazer" should read --layer--.

Signed and Sealed this

*Tenth* Day of *May 1983*

[SEAL]

*Attest:*

GERALD J. MOSSINGHOFF

*Attesting Officer*

*Commissioner of Patents and Trademarks*